US005966842A

United States Patent [19]

Hart, Jr.

[11] Patent Number: 5,966,842

[45] Date of Patent: Oct. 19, 1999

[54] FOOT STRAP ASSEMBLY FOR WADER BOOTS

[76] Inventor: Charles Richard Hart, Jr., 418 Via De La Paz, Pacific Palisades, Calif. 90272

[21] Appl. No.: 09/191,477

[22] Filed: Nov. 12, 1998

Related U.S. Application Data

[60] Provisional application No. 60/083,939, May 1, 1998.

[51] Int. Cl.[6] ..... A43B 23/28; A43B 3/16

[52] U.S. Cl. ..... 36/58.5; 36/7.1 R; 36/50.1

[58] Field of Search ..... 36/1, 2 R, 2 A, 36/1.5, 7.1 R, 89, 91, 92, 50.1, 58.5, 58.6

[56] References Cited

U.S. PATENT DOCUMENTS

| | | | |
|---|---|---|---|
| 193,342 | 7/1877 | Mills . | |
| D. 253,917 | 1/1980 | Wilkinson . | |
| 430,982 | 6/1890 | Ziegler | 36/58.5 |
| 719,344 | 1/1903 | Leathers . | |
| 876,091 | 1/1908 | Reed | 36/58.5 |
| 892,152 | 6/1908 | Harman . | |
| 950,862 | 3/1910 | Nelson | 36/58.5 |
| 1,155,506 | 10/1915 | Osaki . | |
| 1,206,180 | 11/1916 | Ward | 36/58.5 |
| 1,513,539 | 7/1924 | East . | |
| 1,550,269 | 10/1925 | Lanctot . | |
| 1,592,886 | 6/1926 | Harman . | |
| 1,655,715 | 1/1928 | Sneeston | 36/58.5 |
| 1,717,690 | 6/1929 | Ihnen | 36/7.1 R |
| 1,980,486 | 11/1934 | King et al. . | |
| 4,458,431 | 7/1984 | Sinclair . | |
| 4,523,394 | 6/1985 | Lindh et al. . | |
| 4,793,075 | 12/1988 | Thatcher | 36/58.5 |
| 5,148,614 | 9/1992 | Kelly . | |
| 5,175,947 | 1/1993 | Parracho . | |
| 5,435,080 | 7/1995 | Meiselman . | |

FOREIGN PATENT DOCUMENTS

| | | | |
|---|---|---|---|
| 139988 | 12/1932 | Germany | 36/58.5 |
| 57856 | 3/1922 | United Kingdom | 36/58.5 |

*Primary Examiner*—M. D. Patterson

*Attorney, Agent, or Firm*—Kelly Bauersfeld; Lowry & Kelley, LLP

[57] ABSTRACT

A foot strap assembly for wader boots is provided whereby a foot and leg may be more securely held within the wader boot preventing the boot from becoming stuck between rocks or mud which may cause injury to a boot wearer. The foot strap assembly includes an adjustable leg strap which encircles an upwardly extending portion of the wader boot, an adjustable foot strap which extends downwardly from the leg strap to underlie the bottom of the wader boot, an adjustable front strap which is tethered to the leg strap and which encircles the front portion of the boot. The foot strap assembly is positioned around the outside of the boot and adjusted to hold the foot securely within the boot. Adjustable rear straps extending from the leg strap to the foot strap, and beyond to front strap, may be used for further support.

14 Claims, 2 Drawing Sheets

FOOT STRAP ASSEMBLY FOR WADER BOOTS

RELATED APPLICATION

This application claims priority from Provisional Patent Application No. 06/083,939 filed May 1, 1998.

BACKGROUND OF THE INVENTION

This invention relates to sporting goods. More specifically, the present invention relates to a strap arrangement utilized in connection with wader boots to help hold a foot and lower leg securely within the wader boot.

Wader boots are well known to fisherman and hunters. A fisherman or hunter will often put his or her stocking feet within the wader boot, which may or may not be close to the right size for his or her foot, and walk out into a stream or river and/or wade in mud while hunting. When the wader boot is not precisely the same size as the wearer's foot, the foot tends to slip lengthwise within the boot and, over time, such becomes uncomfortable for the fisherman or hunter. The problem is exacerbated when water accumulates in the bottom of the wader boot. Further, if the wader boot is not secure, the wearer's feet have a tendency to slip out of the boot when the bottom of the lake or stream is soft or muddy. This can be potentially dangerous in that the person can trip and fall into the water, thus risking drowning.

There are many devices in the prior art which utilize straps on shoes for various purposes.

U.S. Pat. No. 193,342 to Mills discloses the use of a boot strap for a stir-up and rowel.

U.S. Pat. No. 892,152 to Harman discloses the use of a strap and plate which protect the shoe when using a hand shovel.

U.S. Pat. No. 1,155,506 to Osaki discloses the use of a strapping mechanism to maintain the shape and increase the life of the shoe.

U.S. Pat. No. 1,513,539 to East discloses the use of a strapped toothed plate to be used as a anti-slipping device.

U.S. Pat. No. 5,175,947 to Parracho discloses the use of a removable Y-shaped sheet spring for ankle support in athletic shoes.

None of the above noted prior devices resolve the problems associated with using wader boots in streams or in the mud. Accordingly, there is a need for some type of adjustment mechanism which would permit a fisherman's or hunter's foot to be more securely positioned within the wader boot to prevent it from sliding lengthwise. Additionally, such a device is needed which can be adapted for use with virtually any type and style of wader boot, and adjusted to fit the needs of an individual fisherman or hunter. The present invention fulfills these needs and provides other related advantages.

SUMMARY OF THE INVENTION

This invention addresses a need that has not been met by any other device. More particularly, wading boots do not currently have any device to secure the boot to the foot. When attempting to walk in water or mud, there is a tendency for the foot to move up and down and lengthwise in the boot. Furthermore, when walking in a muddy body of water, the boot can get stuck in the mud which makes it difficult to walk without a snug fit to the foot. The tendency in this situation is for the foot to pull out of the boot causing the person to become unbalanced and possibly fall in the water. In addition, it is very difficult to remove the boot that is stuck in the mud without the leverage of the foot and leg.

The present invention resides in a foot strap assembly for wader boots which holds the foot in the boot, thereby giving the leverage necessary to remove the boot from the mud or from a wedge in a rock. Moreover, the foot strap assembly helps to prevent sprain and injuries to a person's leg and foot because it gives support to the foot and leg in the boot, preventing slipping and jerking of the leg and foot while in the boot.

The foot strap assembly includes an adjustable leg strap which encircles an upwardly extending portion of the wader boot. The leg strap is connected to an adjustable foot strap, the ends of which may be connected to sliding clips which, in turn, are connected to the leg strap for adjusting the position of the foot strap along the leg strap. The foot strap underlies the bottom of the boot. The leg strap is tethered to an adjustable front strap by an adjustable top strap. The front strap encircles the front portion of the boot. Both the leg strap and the front strap are preferably provided safety release clips. The foot strap assembly is positioned around the outside of the boot in the manner described above, and adjusted to hold the foot securely within the boot. Adjustable rear straps extending from the leg strap to the foot strap, and even beyond to the front strap, may be used for further support.

BRIEF DESCRIPTION OF THE DRAWINGS

The accompanying drawings illustrate the invention. In such drawings.

DETAILED DESCRIPTION OF THE PREFERRED EMBODIMENT

Figure 1:
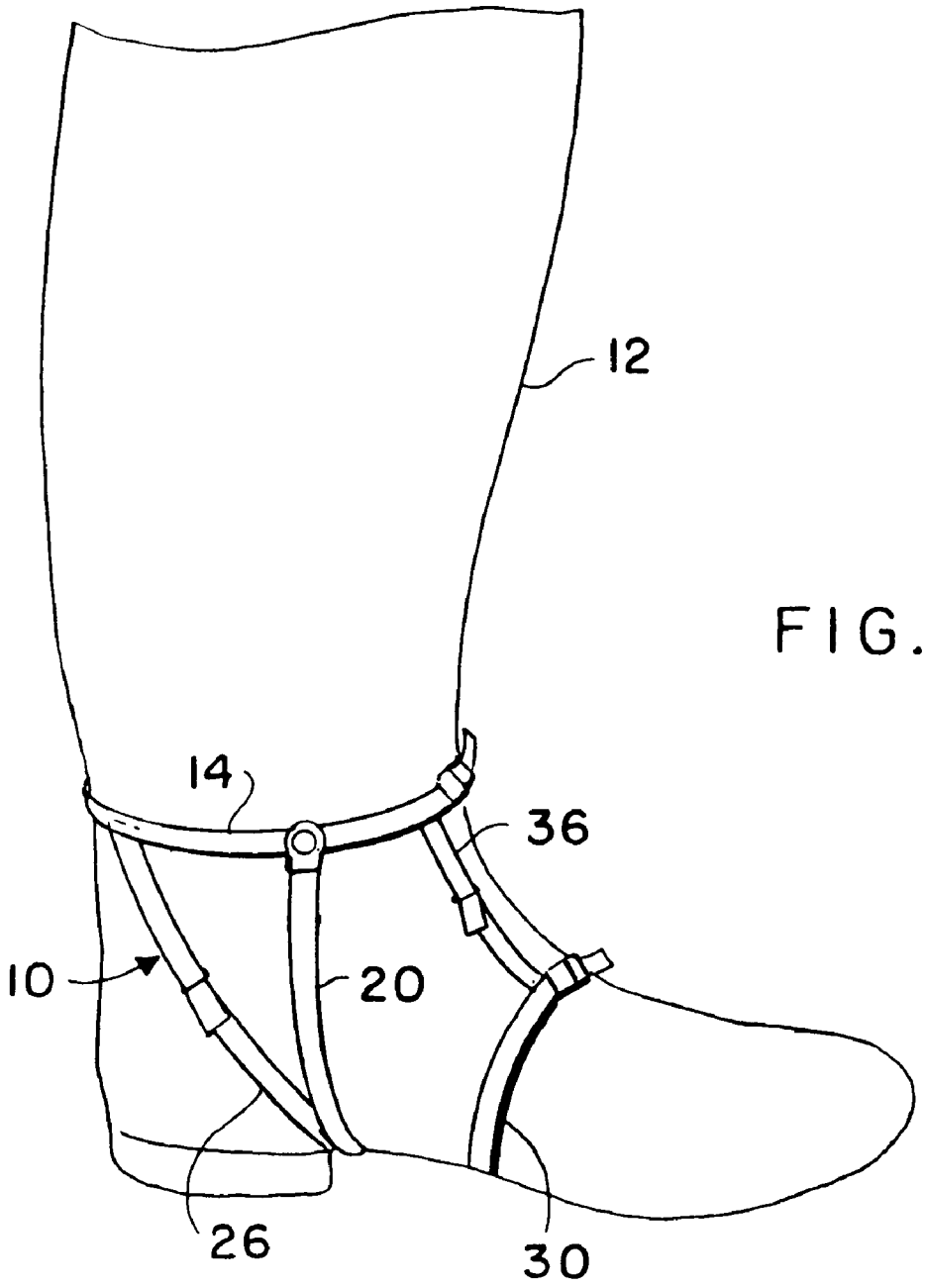
FIG. 1 is a fragmented side elevational view of a wader boot having the foot strap assembly of the present invention fitted thereto.
Figure 2:
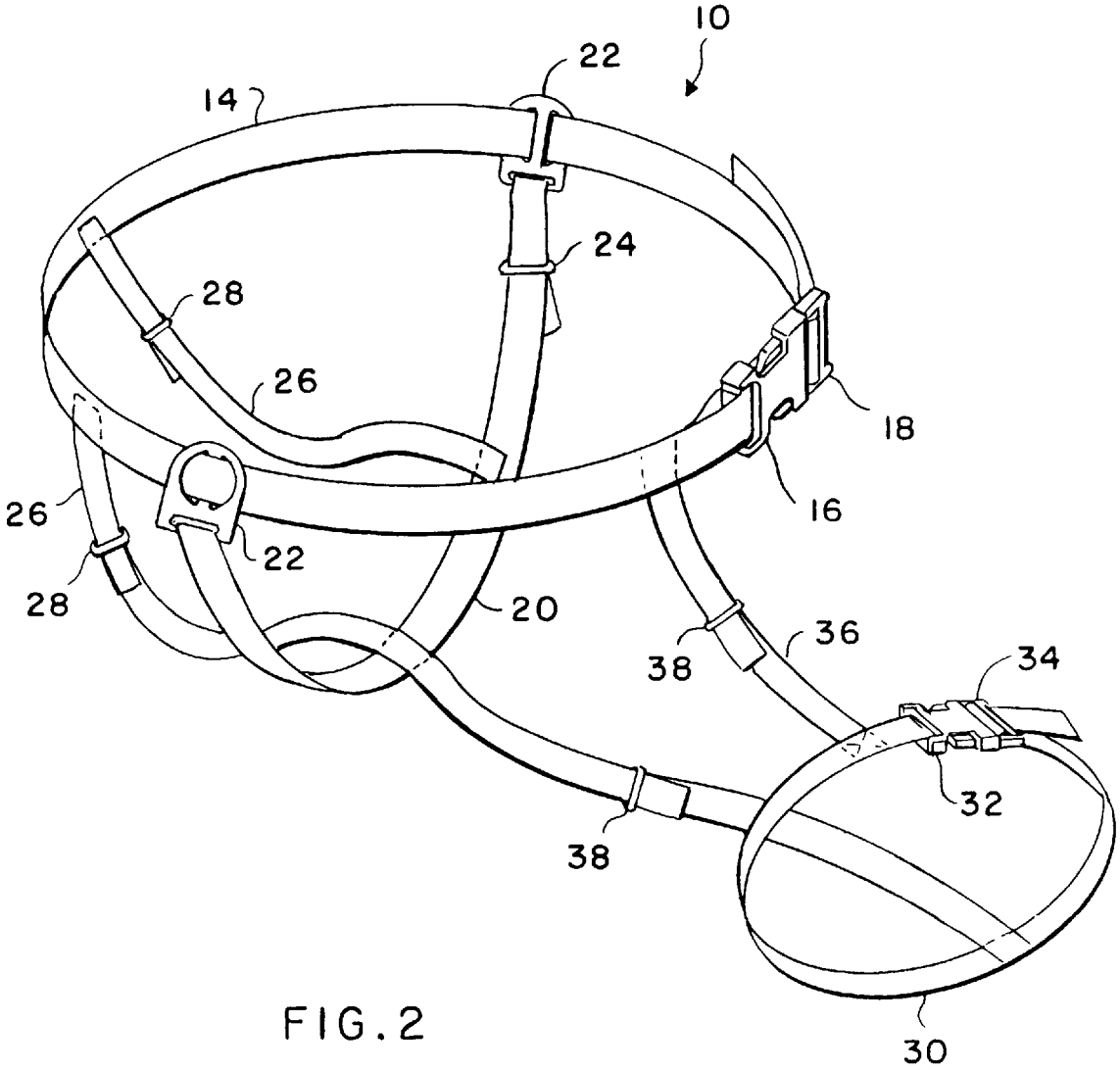
FIG. 2 is a perspective view of the foot strap assembly for a wader boot, shown removed from the wader boot of FIG. 1.

As shown in the drawings for purposes of illustration, the present invention is concerned with a foot strap assembly, generally designed in the accompanying drawings by the reference number 10. The foot strap assembly is intended to be placed about the lower portion of a wader boot 12 and adjusted to securely hold the foot of a person properly within the wader boot.

The foot strap assembly 10 includes a leg strap 14 which is configured to encircle a lower portion of the leg exteriorly of the wader boot 12. The leg strap 14 includes a safety release clip 16 that incorporates an adjustment buckle 18 that permits the leg strap 14 to be tightened or loosened as desired.

A foot strap 20 extends from two sliding clips 22 downwardly from the leg strap 14. The sliding clips 22 are positioned on the leg strap 14 so as to be freely positionable along its length. As shown in FIG. 1, when the foot strap assembly 10 is properly placed upon the wader boot 12, the foot strap 20 extends from the leg strap vertically downwardly and around the foot immediately in front of the heel on both sides of the user's foot. An adjustment buckle 24 is provided to permit the wearer to adjust the length of the foot strap 20 so as to securely hold the leg strap 14 in place and, cooperatively, the wearer's foot in place within the wader boot 12.

A pair of adjustable rear straps 26 are sewn to, respectively, the leg strap 14 and the foot strap 20. Each rear strap 26 is provided with an adjustment buckle 28 similar to the buckles 18 and 24 described previously.

A front strap 30 is provided to encircle a front part of the wader boot 12. The front strap 30 is provided with a safety release clip 32 that incorporates an adjustment buckle 34 that permits the front strap to be tightened or loosened as desired.

A top strap 36 extends from the leg strap 14 downwardly over the top of the boot 12 to the front strap 30. An adjustment buckle 38 is provided to permit the wearer to adjust the length of the top strap 36 so as to securely hold the front strap 30 in place and, cooperatively, the wearer's foot in place within the wader boot 12. Similarly, a rear strap 26 may extend to the front strap 30 and include an adjustment buckle 38 to more securely hold the front strap 30 in place.

In use, the leg strap 14, the foot strap 20, the rear straps 26, the top strap 36 and the front strap 30 are all loosened and the safety release clips 16 and 32 are unbuckled to permit the foot strap assembly 10 to be placed loosely about the wader boot 12. The foot strap 20 is placed beneath the wader boot immediately in front of the heal portion, and then the safety release clips 16 and 32 are buckled. The wearer would then proceed to tighten each of the leg strap 14, foot strap 20, rear straps 26, top strap 36 and front strap 30 utilizing the adjustment buckles 18, 24, 28, 34 and 38 so as to securely hold the wearer's foot within the wader boot 12. The foot strap assembly 10, when properly worn and adjusted, will prevent the wearer's foot from sliding within the wader boot 12 and yet, in an emergency situation, can be easily removed by simply releasing the safety release clip 16 and, if necessary, the safety release clip 32.

Although the description set forth above describes in detail the present invention for purposes of illustration, various modifications may be made without departing from the spirit and scope of the invention. Accordingly, the invention is not to be limited, except as by the appended claims.

What is claimed is:

1. A foot strap assembly for a wader boot, comprising:

a leg strap for encircling an upwardly extending portion of the wader boot;

a foot strap extending downwardly from the leg strap to underlie the bottom of the wader boot;

a pair of rear straps extending between the foot strap and the leg strap; and a front strap tethered to the leg strap, for encircling a front portion of the wader boot.

2. The foot strap assembly of claim 1, wherein the leg strap includes a release clip having an adjustment buckle.

3. The foot strap assembly of claim 1, wherein the front strap includes a release clip having an adjustment buckle.

4. The foot strap assembly of claim 1, including a top strap which tethers the front strap to the leg strap.

5. The foot strap assembly of claim 1, wherein at least one of the rear straps extends beyond the foot strap to the front strap.

6. The foot strap assembly of claim 1, wherein the foot strap has opposite ends connected to respective clips that are, in turn, slidingly connected to the leg strap.

7. A foot strap assembly for wader boots, comprising:

a leg strap for encircling an upwardly extending portion of the wader boot;

a foot strap having opposite ends connected to the leg strap and extending downwardly therefrom to underlie the bottom the wader boot;

a pair of rear straps extending between the foot strap and the leg strap; and a front strap tethered to the leg strap, for encircling a front portion of the wader boot.

8. The foot strap assembly of claim 7, wherein the leg strap and the front strap each include a respective release clip.

9. The foot strap assembly of claim 7, including a top strap which tethers the front strap to the leg strap.

10. The foot strap assembly of claim 7, wherein at least one of the rear straps includes an extended portion which extends from the foot strap to the front strap.

11. The foot strap assembly of claim 10, wherein the extended portion includes an adjustment buckle.

12. A foot strap assembly for wader boots, comprising:

a leg strap having a safety release clip, for encircling an upwardly extending portion of the wader boot;

a foot strap having opposite ends connected to respective clips that are, in turn, connected to the leg strap, the foot strap extending downwardly from the leg strap to underlie the bottom of the wader boot;

a pair of rear straps extending between the leg strap and the foot strap; and a front strap having a safety release clip and tethered to the leg strap by a top strap, for encircling a front portion of the wader boot.

13. The foot strap assembly of claim 12, wherein at least one of the rear straps includes an extended portion which extends from the foot strap to the front strap.

14. The foot strap assembly of claim 13, wherein the extended portion includes an adjustment buckle.

* * * * *